US006651903B1

(12) United States Patent
Nuss

(10) Patent No.: US 6,651,903 B1
(45) Date of Patent: Nov. 25, 2003

(54) ANTI-CONSOLIDATION SPRAY RING

(75) Inventor: W. Philip Nuss, Covington, LA (US)

(73) Assignee: VT Halter Marine, Inc., Gulfport, MS (US)

( * ) Notice: Subject to any disclaimer, the term of this patent is extended or adjusted under 35 U.S.C. 154(b) by 0 days.

(21) Appl. No.: 09/626,892

(22) Filed: Jul. 27, 2000

(51) Int. Cl.[7] ..... B05B 9/00; B05B 15/10; B05B 3/02; B05B 1/20; A62C 13/62

(52) U.S. Cl. ..... 239/127; 239/207; 239/161; 239/163; 239/302; 239/159

(58) Field of Search ..... 239/127, 207, 239/662, 159, 161, 163, 726, 302, 379, 1; 175/339, 393, 442, 400; 134/34, 95.3, 172, 199

(56) References Cited

U.S. PATENT DOCUMENTS

| | | | | | |
|---|---|---|---|---|---|
| 3,570,724 | A | * | 3/1971 | Fontein | 222/478 |
| 4,168,801 | A | * | 9/1979 | Kuck et al. | 239/172 |
| 4,924,949 | A | * | 5/1990 | Curlett | 175/25 |
| 5,450,906 | A | * | 9/1995 | Courtney | 169/46 |
| 5,462,232 | A | * | 10/1995 | Vastveit | 239/662 |

* cited by examiner

*Primary Examiner*—Davis Hwu
(74) *Attorney, Agent, or Firm*—Len R. Brignac

(57) ABSTRACT

The invention is directed to a unique tank and ring system for transporting and circulating high specific gravity soluble fluid on board a vessel.

11 Claims, 4 Drawing Sheets

ANTI-CONSOLIDATION SPRAY RING

BACKGROUND OF THE INVENTION

FIELD OF THE INVENTION

Ships have taken drilling mud to offshore rigs for many years. Traditional systems used square tanks with jets to keep the mud circulating. Mud would get trapped in the edges of the tanks. The invention has been developed to enable complete circulation of high specific gravity soluble fluid, such as liquid mud while a ship is underway from land to a rig without trapping mud in corners or crevices of the tanks.

SUMMARY OF THE INVENTION

The present invention is related to a vessel containing a unique circulation system for the transport and circulation of drilling muds, a vessel comprising:

(a) a hull having-a deck with deck connectors; and (b) a high specific gravity soluble fluid, such as liquid mud transfer system and high specific gravity soluble fluid circulation system comprising;

i. a transfer system comprising:

(a) a supply line;

(b) a tank connected to supply line having a sloping double bottom;

(c) a ring contained within tank and connected to supply line having nozzles for spraying liquid mud into tank;

(d) a control means connected to supply line for opening and closing supply line;

(e) moving high specific gravity soluble fluid from a pressurized source into the supply line; and (f) a suction line having an additional suction branch for the circulation line with one end in tank and a sump for removing high specific gravity soluble fluid from tank through a transfer pump to deck connector; and ii. a high specific gravity soluble fluid circulation system comprising:

(a) the suction line providing high specific gravity soluble fluid from the tank to a circulation pump;

(b) a circulation pump for pressurizing the ring;

(c) a connecting line to move high specific gravity soluble fluid from the circulation pump to the supply line;

(d) high specific gravity soluble fluid is pumped through the supply line into the ring; and (e) nozzles removably attached to ring to spray high specific gravity soluble fluid from ring into tank.

An object of the invention is to prevent the consolidation of high specific gravity soluble fluid, such as liquid mud in a tank for transport and minimize the stagnation zone in the tank, thereby allowing the transfer of a more homogeneous liquid to the user of the high specific gravity soluble fluid which can be liquid mud for drilling.

DETAILED DESCRIPTION OF THE INVENTION

Figure 1A:
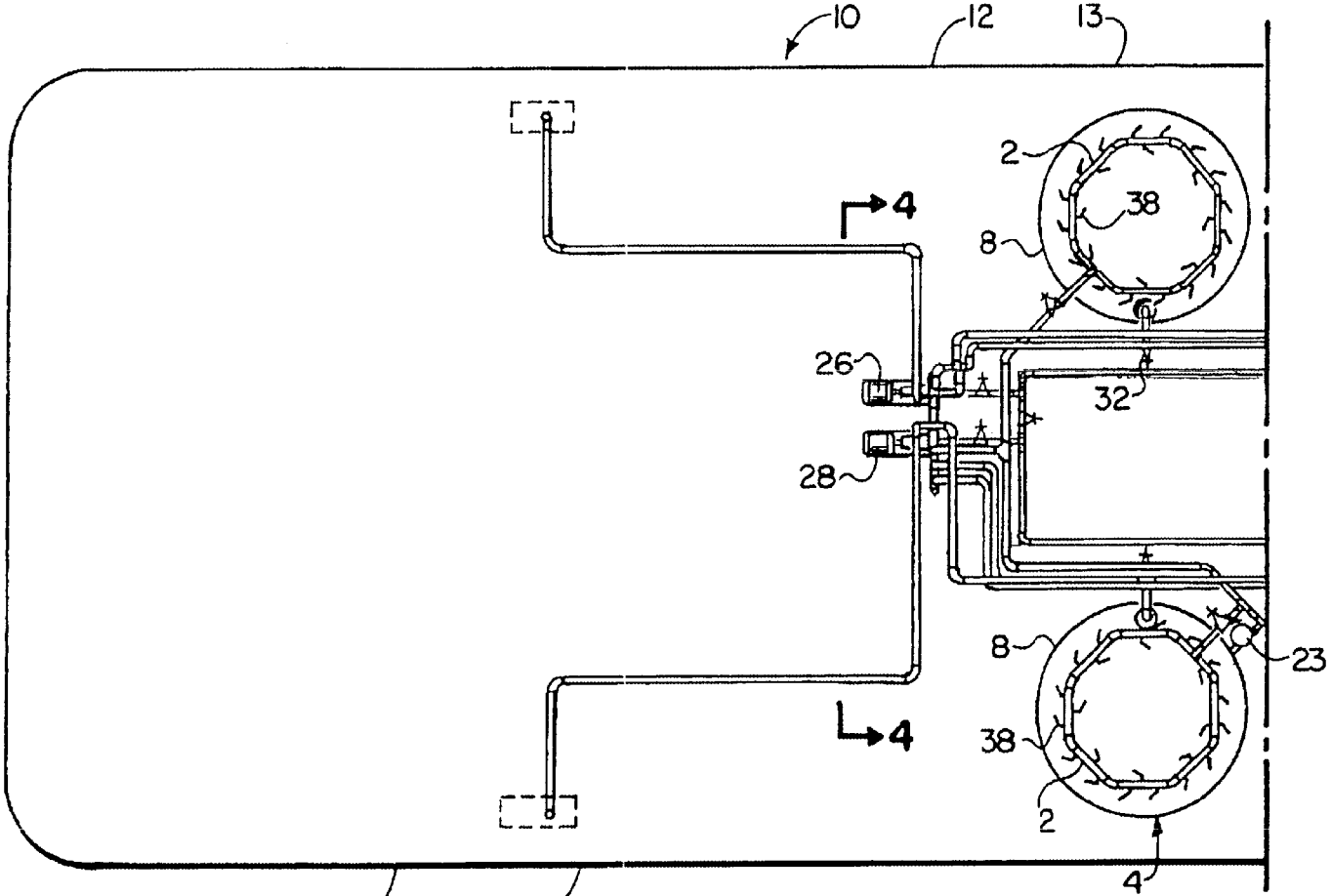
FIG. 1 is top view of a ship containing the invention.
Figure 1B:
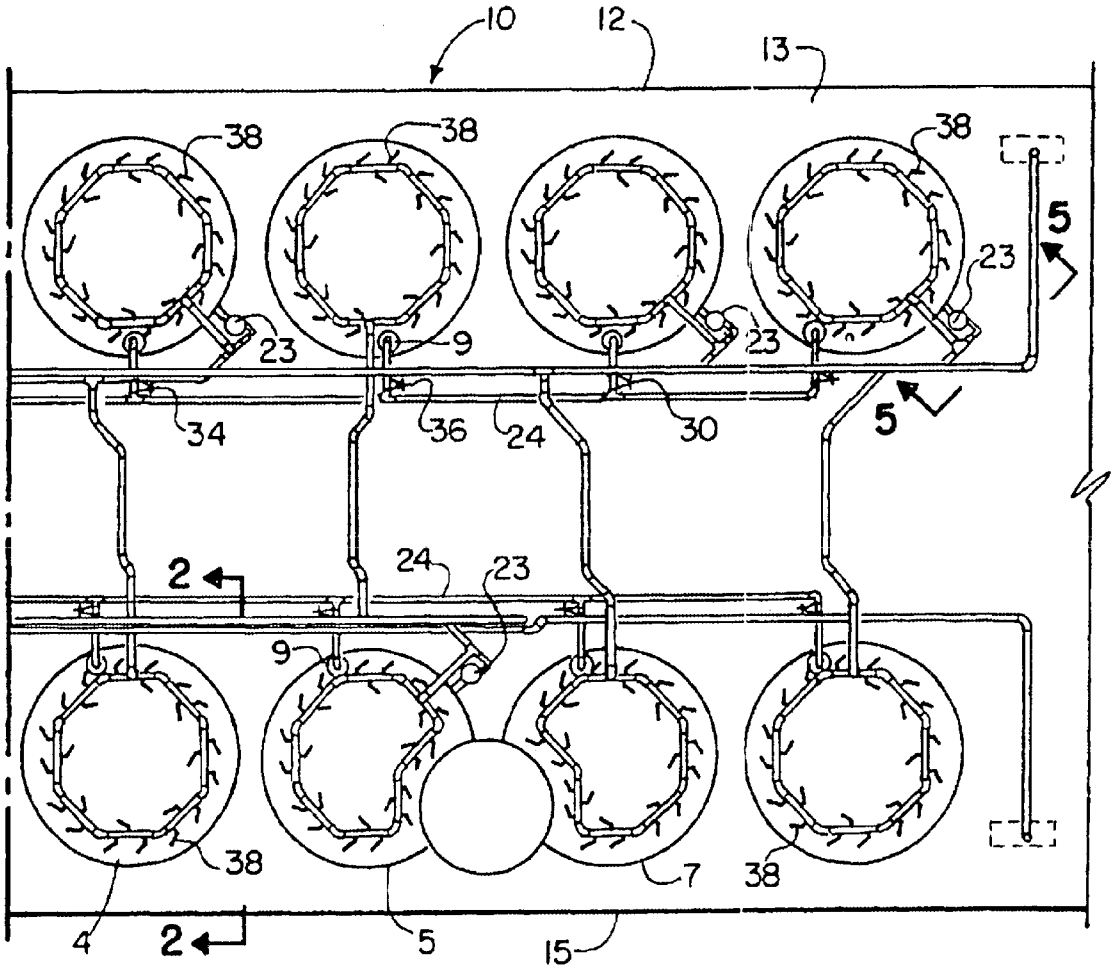

FIG. 1 shows a ship or vessel (10) having a hull (12) into which is welded a plurality of tanks of which (4), (5) and (7) are typical and which are used as part of the novel invention. The invention relates to a circulation system consisting of a tank (4) containing at least one ring (2), which is made from tubular material having an inner diameter of between 2 and 10 inches, and most preferably 5 inches, and contained inside the tank (4). In the most preferred embodiment, the ring and the tank are made of steel, however other materials may be used. The ring may be constructed of polymer, or a metal alloy, which can tolerate corrosive and abrasive environments. Additionally, two or more rings may be used in one tank and remain within the scope of the invention.

FIG. 1 shows a vessel (10) having 10 tanks and 10 rings, however, it should be noted that the rings do not have to be perfectly round, as shown with tanks (5) and (7). It is considered to be within the scope of the invention to create a vessel with up to 30 tanks each containing a ring.

Figure 2:
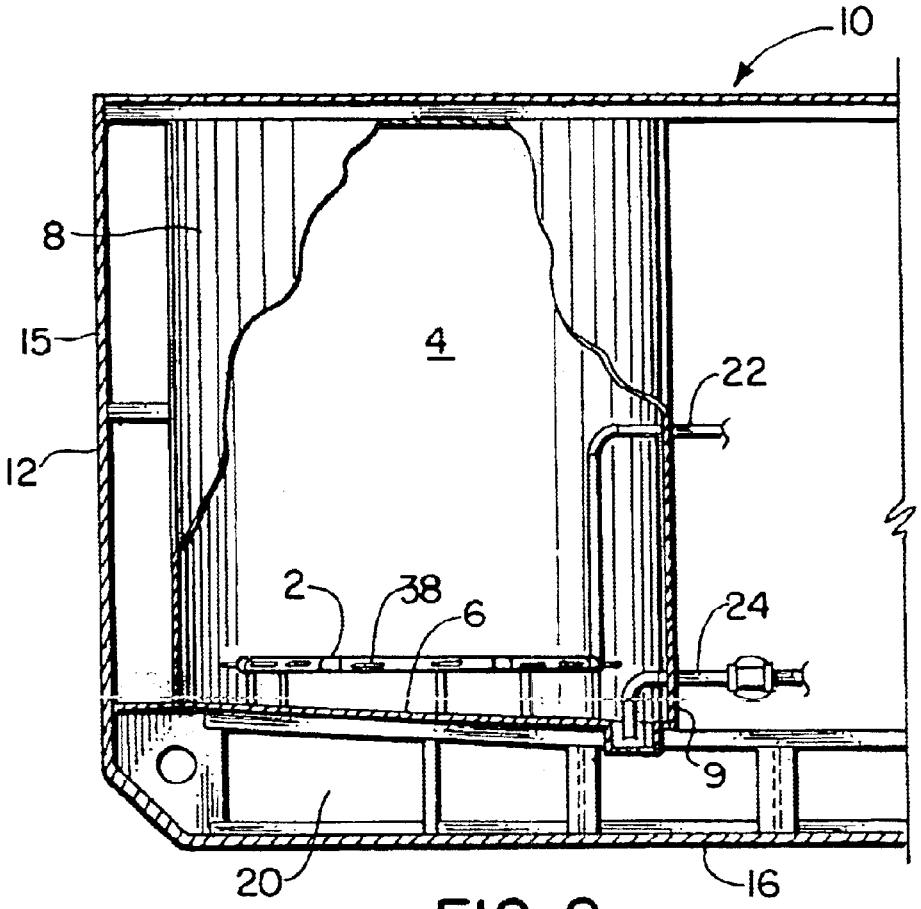
FIG. 2 is a cross sectional view of the hull of the vessel containing the invention.

Each tank (4) (5) or (7) or one of the many other tanks used in the hull of the vessel, preferably has a sloping bottom (6) shown in FIG. 2. The sloping bottom (6) permits drainage to the suction sump (9) to minimize stripping, and facilitate removable of the remaining small amounts of liquid traditionally left in the tank. Each tank (4) preferably has a circular wall (8).

Figure 3:
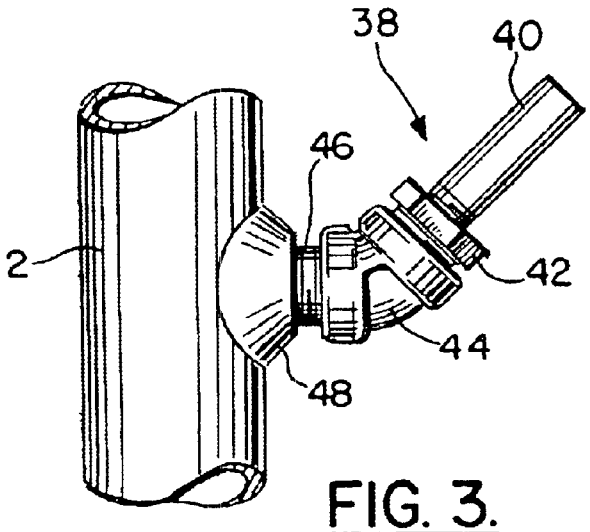
FIG. 3 is a detail of the nozzles used in the invention.

Ring (2) in the tank (4) is equipped with a plurality of removably attached nozzles shown in FIG. 3 as (38) along the side of each ring (2). The nozzles are positioned so that more than half of the nozzles are positioned on the portion of the ring pointing towards the inner walls of the tank (4). With the balance of the nozzles being positioned to point towards the center of the tank. The orientation of the nozzles is important, as the nozzles must be positioned to spray out the high specific gravity soluble fluid and keep it circulating in the tank in a generally circular pattern. Preferably between 12 and 38 nozzles can be used on the ring (2). Preferably, the tank is vented on the top. Features for the tank include a float check on the vent to seal the tank. A flame screen (not shown) can be installed on the vent top as well. An insect screen also could be installed on the tank vent to prevent bugs from getting into the high specific gravity soluble fluid.

The tank (4) is welded or secured to the inside of the hull (12) of vessel (10). In FIG. 1, the port side of the hull is (13), the starboard side of the hull is (15). The hull bottom is shown as (16). FIG. 2 shows the hull bottom (16) in the preferably double-hulled configuration has voids (20). The voids (20) can be used as fuel tanks, or ballast, water tanks or cargo space. In this embodiment, the supply line is shown as (22) and the suction line is shown as (24).

FIG. 3 is the detail of the nozzle. The nozzles (38) are preferably of a size and quantity to maintain a "jetting action" of mud circulating in the tank. The velocity of the mud in the tank should preferably be between 15 and 20 feet per second, so that the high specific gravity soluble fluid, such as liquid mud does not settle and consolidate in the tank. The nozzle (38) is shown having a nipple (40), a bushing (42) which is threaded in the preferred embodiment. An elbow (44) is connected to the bushing (42) which can, optionally also be threaded. A pipe nipple (46) is preferably threaded to the elbow (44) and to a Thread-o-let (48). The nozzle assembly is welded to the circulation ring (2).

Figure 4:
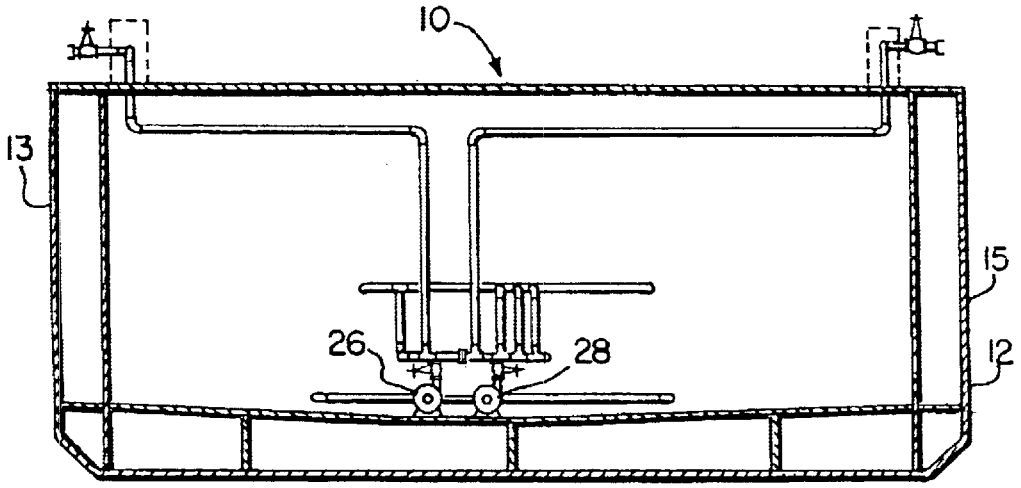
FIG. 4 is a cross sectional view of a transfer pump and the discharge portion of the transfer system.

FIG. 4 shows the hull in cross section. Pumps (38) are shown for suctioning the high specific gravity soluble fluid, such as liquid mud from the tank.

Figure 5:
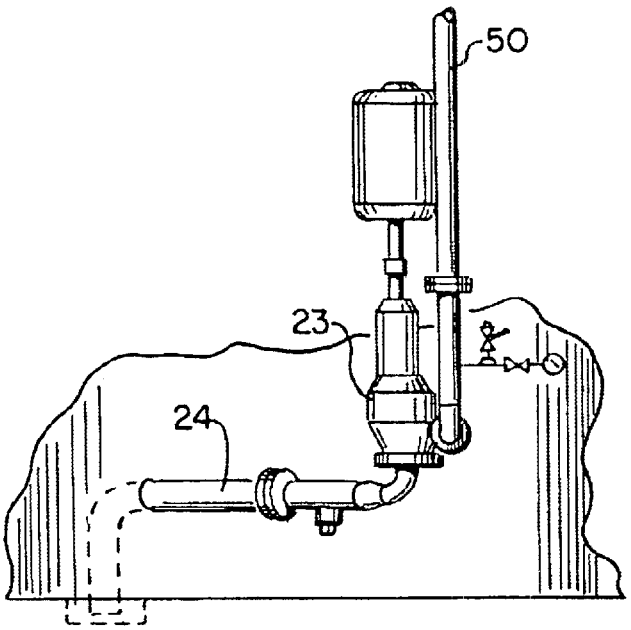
FIG. 5 is an isolated view of the circulation pump of the circulation system.

FIG. 5 shows a detail of the circulation pump (23) connected to the supply line (22) via connecting line (50). The circulation pump (23) pumps mud into the ring (2), essentially pressurizing the ring (2) which permits the mud to flow from the ring through the nozzles into the tank. The ring is preferably pressurized to between 5 psi and 75 psi.

Returning to FIG. 1, pumps (26) and (28) can be used for suctioning mud from any tank to the deck connector. Centrifugal pumps may be used for this suctioning operation. One pump can work in this capacity. Various isolation valves can be used in this system, and are depicted as (30), (32), (34) and (36).

Ring (2) can be made of segments of pipe, such as elbows, flanges or from a continuous welded circular ring of bent pipe with take down flanges.

To initiate the transfer system:

Step 1—Open the suction and discharge valves to flood the suction line and transfer pumps;

Step 2—Turn on the transfer pump to begin moving liquid mud from the tank to the deck connection; and Step 3—Open deck discharge valves to permit egress of fluid from tank off of the vessel.

To initiate the circulation system:

Step 1—Open the suction and discharge valves to flood the suction line and circulation pump; and Step 2—Turn on the circulation pump to begin moving liquid mud from the tank back to the circulation ring.

It is to be understood that the present invention is not limited to the embodiments described above, but encompasses any and all embodiments within the scope of the following claims.

What is claimed is:

1. A vessel comprising:

(a) a hull having a deck with deck connectors; and (b) a high specific gravity soluble fluid, such as liquid mud transfer system and high specific gravity soluble fluid circulation system comprising;

(i) a transfer system comprising (a) a supply line;

(b) a tank connected to said supply line having a sloping double bottom;

(c) a ring contained within said tank and connected to said supply line having nozzles for spraying liquid mud into said tanks;

(d) a control means connected to said supply line for opening and closing said supply line;

(e) moving high specific gravity soluble fluid from a pressurized source into the supply line; and (f) a suction line having an additional suction branch for a circulation line with one end in said tank and a sump for removing said high specific gravity soluble fluid from said tank through a transfer pump to said deck connector; and (ii) a high specific gravity soluble fluid circulation system comprising:

(a) a suction line providing high specific gravity soluble fluid from the tank to a circulation pump;

(b) a circulation pump for pressuring the rings;

(c) a connecting line to move high specific gravity soluble fluid from the circulation pump to the supply line;

(d) high specific gravity soluble fluid is pumped through the supply line into the ring; and (e) nozzles removably attached to said ring to spray high specific gravity soluble fluid from said ring into said tank.

2. The vessel of claim 1, further comprising between 12 and 38 nozzles pering.

3. The vessel of claim 1, wherein said ring is generally circular.

4. The vessel of claim 1, wherein the nozzles are orientated so as to create a circular flow pattern of high specific gravity soluble fluid within said tank.

5. The vessel of claim 1, further comprising between 2 and 30 tanks.

6. The vessel of claim 1, further comprising valve isolation means which enables different types of high specific gravity soluble fluid to be inserted into different tanks without contaminating said supply lines or tanks and permitting the circulation system to operate independently of the transfer system.

7. The vessel of claim 1 wherein the transfer pump can be used in said high specific gravity soluble fluid circulation system.

8. The vessel of claim 1, wherein the high specific soluble gravity fluid is a soluble drilling fluid.

9. The vessel of claim 8 wherein the soluble drilling fluid is liquid mud.

10. A circulation system for facilitation the circulation of high specific gravity soluble fluid in a tank comprising:

(a) a tank for holding high specific gravity soluble fluid;

(b) a suction line for moving high specific gravity soluble fluid from said tank to a circulation pump;

(c) a connection lime to move high specific gravity soluble fluid from the circulation pump to a supply line;

(d) a supply line for transferring high specific gravity soluble fluid into a ring; and (e) nozzles connected to said pipe ring for spraying high specific gravity soluble fluid in said tank; wherein said tank has a sloping bottom.

11. A circulation system for facilitating the circulation of high specific gravity soluble fluid in a tank comprising:

(a) a tank for holding high specific gravity soluble fluid;

(b) a suction line for moving high specific gravity soluble fluid from said tank to a circulation pump;

(c) a connecting line to move high specific gravity soluble fluid from the circulation pump to a supply line;

(d) a supply line for transferring high specific gravity soluble fluid into a ring; and (e) nozzles connected to said pipe ring for spraying high specific gravity soluble fluid in said tank and further comprising valve isolation means which enable different types of high specific gravity soluble fluid to be inserted into different tanks without contaminating the supply lines or tanks.

* * * * *